US012778235B2

(12) United States Patent
Anderson

(10) Patent No.: US 12,778,235 B2
(45) **Date of Patent: *Nov. 3, 2026**

(54) SKI BOOT AND RELATED SYSTEM

(71) Applicant: Richard Peter Anderson, Wanaka (NZ)

(72) Inventor: Richard Peter Anderson, Wanaka (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 18/824,160

(22) Filed: Sep. 4, 2024

(65) Prior Publication Data

US 2025/0057283 A1 Feb. 20, 2025

Related U.S. Application Data

(63) Continuation of application No. 18/540,027, filed on Dec. 14, 2023, now Pat. No. 12,082,650.

(30) Foreign Application Priority Data

Aug. 15, 2023 (AU) ..... 2023902585

(51) Int. Cl.
*A43B 5/04* (2006.01)

(52) U.S. Cl.
CPC ..... *A43B 5/0456* (2013.01)

(58) Field of Classification Search
CPC ..... A43B 5/045; A43B 5/0454; A43B 5/0456; A43B 5/0458; A43B 5/046; A43B 5/0462; A43B 5/0464
See application file for complete search history.

(56) References Cited

U.S. PATENT DOCUMENTS 3,686,778 A * 8/1972 Hornung ..... A43B 5/0458 36/118.4
4,476,640 A * 10/1984 Aldinio ..... A43B 5/0458 36/118.5

(Continued)

FOREIGN PATENT DOCUMENTS

EP 0434663 A2 * 6/1991 ..... A43B 5/0456
EP 3738458 B1 7/2023

(Continued)

OTHER PUBLICATIONS

International Search Report and Written Opinion issued in PCT/NZ2024/050090, dated Oct. 29, 2024, and English translations thereof.

*Primary Examiner* — Patrick J. Lynch
(74) *Attorney, Agent, or Firm* — ARC IP Law, PC; Joseph J. Mayo

(57) ABSTRACT

A ski boot that controls and adjust a forward flex and a rearward rebound movement of a ski boot. The ski boot includes a shell to receive and retain a foot of a skier; a cuff secured to a lower leg of the skier; an adjustable damper that controls the forward flex and the rearward rebound movement of the ski boot; a sensor measuring data about the forward flex and the rearward rebound movement of the ski boot; and mechanical servos or magnetic valves that adjust the adjustable damper in response to the data provided by the sensor. A system is also described that includes the ski boot, a processor that receives and analyzes the data; and a receiver that receives a signal from the processor to adjust the adjustable damper to alter the forward flex and the rearward rebound movement of the ski boot.

18 Claims, 12 Drawing Sheets

(56) References Cited

U.S. PATENT DOCUMENTS

| | | | | | |
|---|---|---|---|---|---|
| 4,570,364 | A * | 2/1986 | Walkhoff | A43B 5/0452 | 36/118.8 |
| 5,437,289 | A * | 8/1995 | Liverance | A63B 69/38 | 600/592 |
| 5,980,435 | A * | 11/1999 | Joutras | A63C 10/04 | 482/8 |
| 7,513,068 | B2 * | 4/2009 | Fauver | A43B 5/1691 | 36/89 |
| 2003/0141701 | A1 | 7/2003 | Holzer | | |
| 2003/0218315 | A1 * | 11/2003 | Wulf | A63C 9/08564 | 280/616 |
| 2008/0155862 | A1 * | 7/2008 | Battlogg | A43B 1/0054 | 36/117.6 |
| 2019/0365020 | A1 | 12/2019 | Holzer et al. | | |
| 2019/0380426 | A1 | 12/2019 | Sun et al. | | |
| 2021/0368908 | A1 | 12/2021 | Drynan | | |

FOREIGN PATENT DOCUMENTS

| | | | | |
|---|---|---|---|---|
| WO | WO-2010092414 | A1 * | 8/2010 | A63B 69/18 |
| WO | 2018/165990 | A1 | 9/2018 | |

* cited by examiner

SKI BOOT AND RELATED SYSTEM

This application is a continuation of U.S. patent application Ser. No. 18/540,027, filed 14 Dec. 2023, which claims priority to Australian Provisional Patent Application Number 2023902585, filed 15 Aug. 2023, the specifications of which are hereby incorporated herein by reference.

BACKGROUND OF THE INVENTION

Field of the Invention

At least one embodiment relates to a ski boot and system. More specifically, at least one embodiment of a ski boot is described comprising an adjustable damping mechanism and instrumentation configured to sense characteristics of the adjustable damping mechanism and allow adjustment of characteristics of ski boot damping. One or more embodiments include a system using the ski boot and sensed data collected from the ski boot is also described.

Description of the Related Art

Ski boots have, over time, taken on various mechanisms to assist a skier to ski in more proficient ways. Existing ski boots however, do not provide adjustable damping or flexion under load. Further, no objective basis may be integrated into existing ski boots for adjusting damping or flexion to suit an individual or to suit ski conditions. Some examples of attempts to modify ski boots are described further below.

U.S. Pat. No. 3,644,919 is directed to a signaling device for indicating improper position of a skier comprising means attachable to the body of the skier and including means responsive to the position of the skier operatively connected with indicating means for causing a signal to indicate when the skier is not in the proper position. In this case, measurement sensors (pressure and rotation) are used in analysis of the action of a skier to alert a skier to improper posture or positioning.

Ski boots have also been developed with mechanisms to monitor and/or adjust boot performance.

For example, U.S. Pat. No. 3,747,235 describes a ski boot comprising a lever and damping arrangements between the body of a ski boot and a pivoted cuff or brace. U.S. Pat. No. 4,476,640 describes the use of a variable rated damper for adjusting the flex of a ski boot. CARV (getcarv.com) produce a ski boot footbed that provides users with feedback that is instruction orientated. This product is not designed or capable of providing ski boot set up advice.

Sensors to sense boot characteristics have been described in the art. One example is U.S. Pat. No. 4,697,360 which describes an instrumented ski boot powered by on-board solar cells having sensors included for detecting proper closure of the boot or to activate ski binding release. U.S. Pat. No. 5,295,704 describes a ski binding with knee flex and ankle flex sensors for determining an angle of knee flex, together with a microprocessor for actuating a ski binding release mechanism. U.S. Pat. No. 5,636,146 describes systems for measuring skier performance using accelerometers and pressure sensors to determine loft time and speed. U.S. Pat. No. 6,095,547 describes active damping using piezoelectric systems within a ski together with active control using a CPU. U.S. Pat. No. 8,239,146 describes systems using sensors on rider knees and pressure sensors between the boots and legs of a wearer to measure ski performance.

Wireless systems and skiing are a more recent development. One example is described in U.S. Pat. No. 8,612,181 which describes a wireless system for monitoring and analysis of skiing.

Ankle flex during skiing and how that interacts with skier performance has been the subject of scientific research. These papers emphasized the importance of ankle flex on performance and reducing injuries. In one paper instrumented ski boots using rotary potentiometers were used to measure skiing ground forces and flexural angles during simulation and real skiing ("An Innovative Compact System to Measure Skiing Ground Reaction Forces and Flexural Angles of Alpine and Touring Ski Boots" published in Sensors, Jan. 2023, authored by NATURE® publishing group in Oct. 2022, authored by Giuseppe Zullo et al of University of Padua).

Despite the above advances in ski boot technology, none of the art to date has combined the element of ski boots with instrumentation to damper boot flex and sensing which monitors boot flex and provides analysis of the in-use data. Existing ski boots do not describe using the sensed information to modify the ski boot damper apparatus and hence, adjust flex rapidly, even in real time as skiing is occurring. The closest equivalent style of system may be a system called the 'Fox live valve' which is used on some mountain bikes to adjust suspension damping as described on the website: www.ridefox.com/content.php?c=livevalve-bike.

For a skier to maintain their balance, control of their skis and, to reduce fatigue, it may be useful to provide adjustment in response to sensed data to optimize skier performance, adjust for different ski conditions, ski styles, ski disciplines and, potentially to also reduce injuries, or at least provide the public with a choice.

Further aspects and advantages of the ski boot and system will become apparent from the ensuing description with the one or more embodiments that is given by way of example only.

BRIEF SUMMARY OF THE INVENTION

At least one embodiment of the invention is a ski boot comprising an adjustable damping mechanism and instrumentation configured to sense characteristics of the adjustable damping mechanism and allow adjustment of characteristics of ski boot damping. A system is also described, by way of at least one embodiment, comprising the ski boot, a processor and a receiver and monitoring and adjustment of ski boot damping characteristics.

In at least one embodiment, there is provided a ski boot configured to control and adjust a forward flex and a rearward rebound movement of a ski boot while the ski boot is in-use, the ski boot comprising:

- a shell configured to receive and retain a foot of a skier;
- a cuff configured to secure to a lower leg of a skier;
- an adjustable damper, the adjustable damper coupled to the shell and the cuff, the adjustable damper configured to control the forward flex and the rearward rebound movement of the ski boot;
- a sensor measuring sensed data about the forward flex and the rearward rebound movement of the ski boot; and
- means to adjust the adjustable damper in response to the sensed data provided by the sensor.

In at least one embodiment, there is provided a system comprising:

- a ski boot configured to control and adjust a forward flex and a rearward rebound movement of a ski boot while the ski boot is in-use, the ski boot comprising:

a shell configured to receive and retain a foot of a skier;

a cuff configured to secure to a lower leg of a skier;

an adjustable damper, the adjustable damper coupled to the shell and the cuff, the adjustable damper configured to control the forward flex and the rearward rebound movement of the ski boot;

a sensor measuring sensed data about the forward flex and the rearward rebound movement of the ski boot; and means to adjust the adjustable damper in response to the sensed data provided by the sensor;

a processor that receives and analyses the sensed data while the ski boot is in use; and a receiver that receives a signal from the processor and which, via the means to adjust the adjustable damper, adjusts the adjustable damper to alter the forward flex and the rearward rebound movement of the ski boot.

Advantages of the above ski boot and system, by way of one or more embodiments, may relate to the ability to collect data on forward flex and rearward rebound movement in-use and optionally, the ability to adjust the forward flex and rearward rebound movement quickly and even automatically whilst skiing. Many other possible advantages have been identified by the inventor that are outlined further below, by way of one or more embodiments.

BRIEF DESCRIPTION OF THE DRAWINGS

Further aspects of the ski boot and system will become apparent from the following description, by way of one or more embodiments, that is given by way of example only and with reference to the accompanying drawings in which.

DETAILED DESCRIPTION OF THE INVENTION

Figure 1:
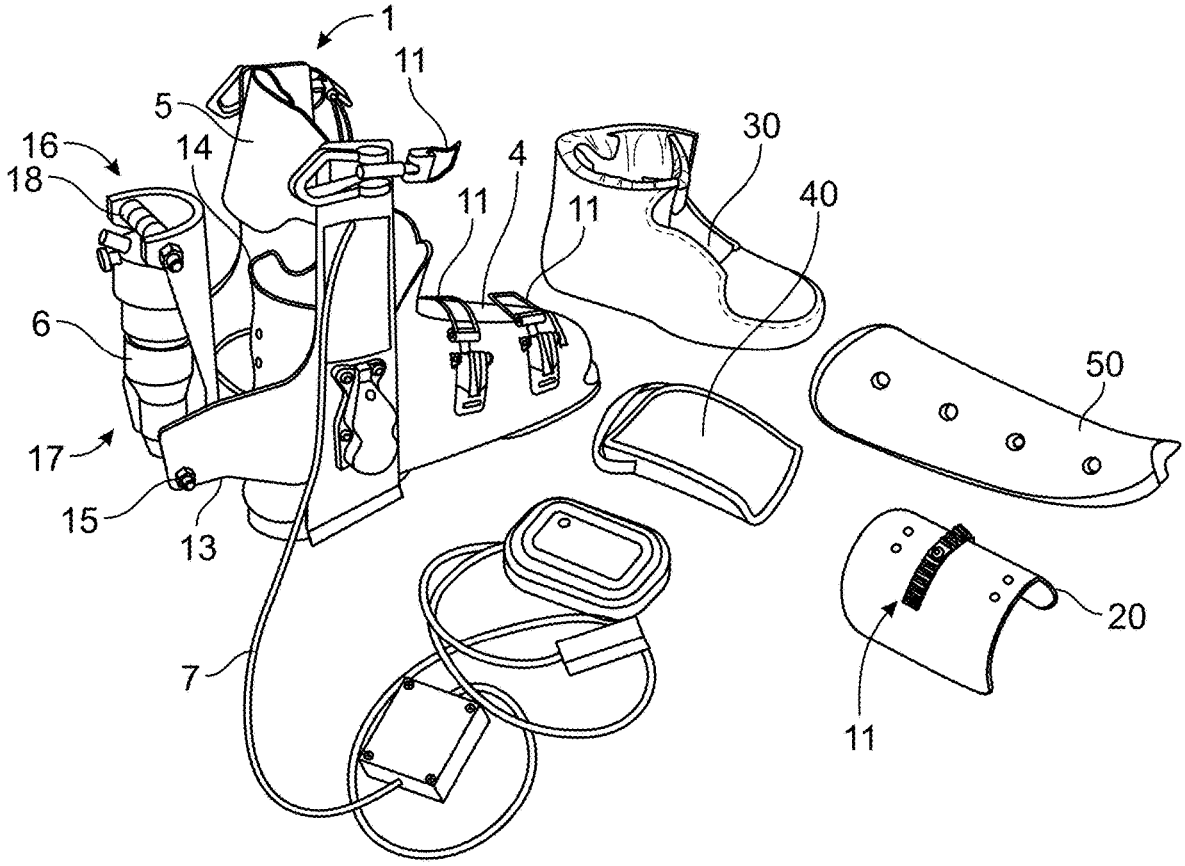
FIG. 1 is a drawing of a prototype ski boot and related parts in an exploded form, according to one or more embodiments of the invention.
Figure 2:
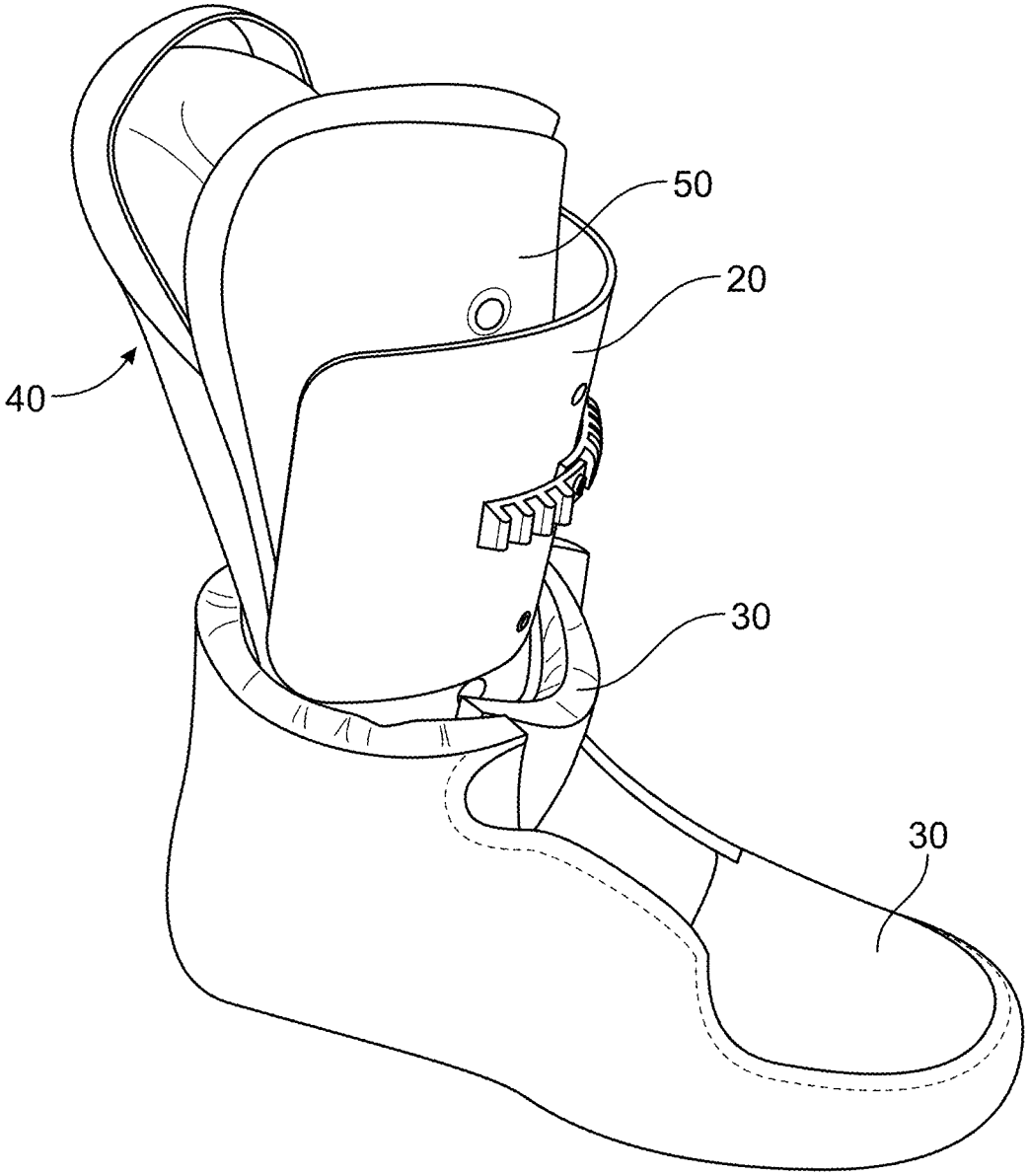
FIG. 2 is a drawing of the shell liner, calf liner, shin guard, and metal cuff assembled together, according to one or more embodiments of the invention.
Figure 3:
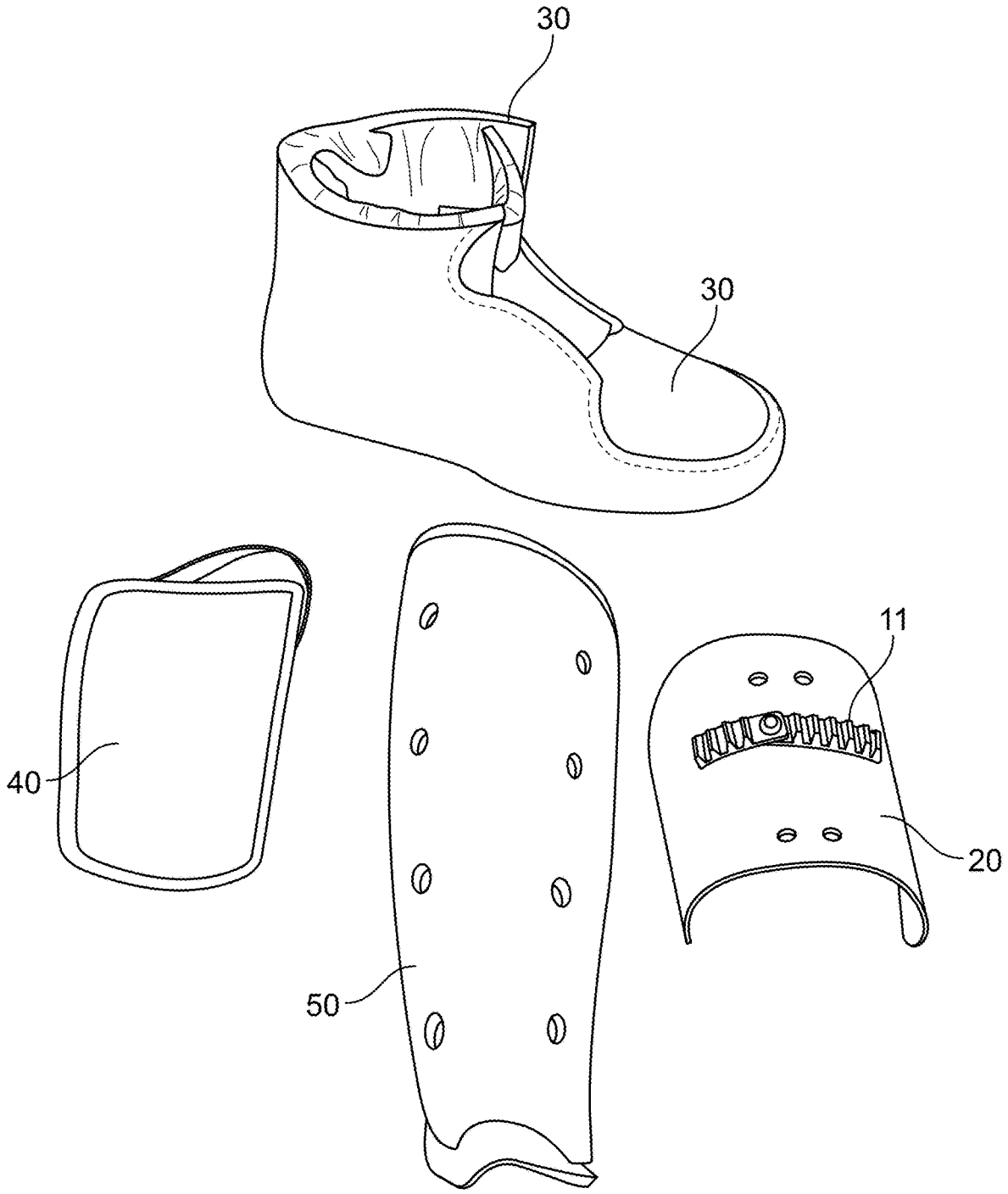
FIG. 3 is a drawing of the shell liner, calf liner, shin guard, and metal cuff in exploded form, according to one or more embodiments of the invention.
Figure 4:
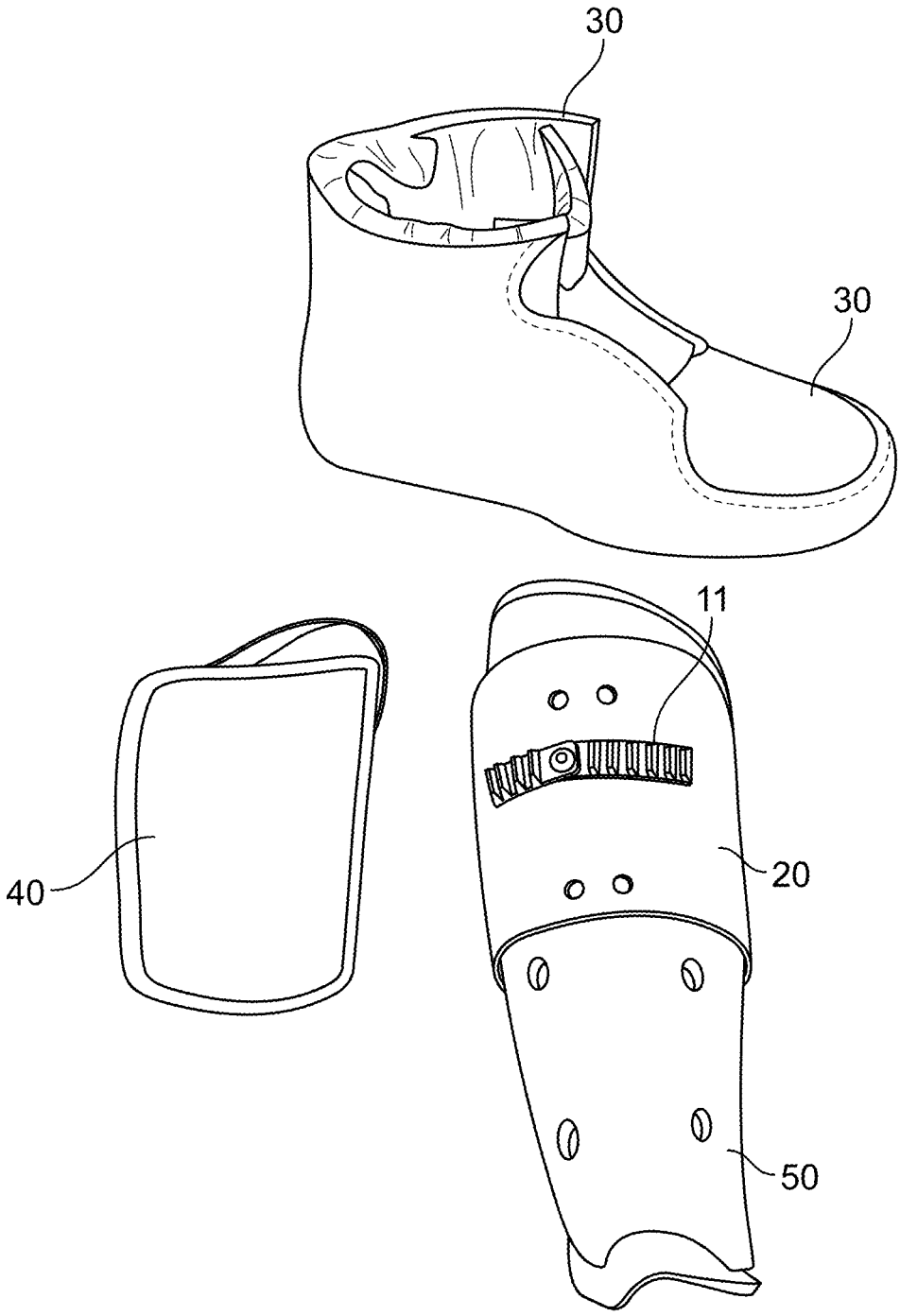
FIG. 4 is a drawing of the shell liner, calf liner, shin guard, and metal cuff in a partly exploded form, according to one or more embodiments of the invention.

As noted above, by way of one or more embodiments, described herein is a ski boot comprising an adjustable damping mechanism and instrumentation configured to sense characteristics of the adjustable damping mechanism and allow adjustment of characteristics of ski boot damping. A system is also described, by way of at least one embodiment, comprising the ski boot, a processor and a receiver and monitoring and adjustment of ski boot damping characteristics.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

A Ski Boot

In at least one embodiment, there is provided a ski boot configured to control and adjust a forward flex and a rearward rebound movement of a ski boot while the ski boot is in-use, the ski boot comprising:

a shell configured to receive and retain a foot of a skier;

a cuff configured to secure to a lower leg of a skier;

an adjustable damper, the adjustable damper coupled to the shell and the cuff, the adjustable damper configured to control the forward flex and the rearward rebound movement of the ski boot;

a sensor measuring sensed data about the forward flex and the rearward rebound movement of the ski boot; and means to adjust the adjustable damper in response to the sensed data provided by the sensor.

Forward Flex and Rearward Rebound Movement

As noted above, in at least one embodiment, the ski boot is configured to control and adjust a forward flex and a rearward rebound movement of a ski boot while the ski boot is in-use.

The term 'forward flex' and grammatical variations thereof as used herein refers to movement of the cuff relative to the shell in a forwards direction i.e. the front of the cuff moves closer to a toe of the shell commensurate with a skier articulating rotation of their lower leg forwards so that the skiers knee moves forwards over their foot or toes of their foot.

The term 'rearward rebound movement' and grammatical variations thereof as used herein refers to movement of the cuff relative to the shell in a rearwards or aft direction i.e. the front of the cuff moves away from a toe of the shell commensurate with a skier articulating rotation of their lower leg rearwards so that the skiers knee moves back from over their foot or toes of their foot.

The characteristics of the forward flex and the rearward rebound movement controlled, in at least one embodiment, may be selected from: the extent of the forward flex and the rearward rebound movement, the speed of forward flex or rearward rebound movement, the acceleration of forward flex or rearward rebound movement, and combinations of these characteristics.

Shell

As noted above, by way of at least one embodiment, the shell is configured to receive and retain a foot of a skier.

In one or more embodiments, the shell may comprise a shoe shape and form with a base that a foot stands on and an enclosure over the foot of a skier. The shell may have a toe or front end, a heel or rear end and sides. While a shoe type configuration is described, the shell may be defined more widely as the foot holding region of the ski boot.

In use, by way of one or more embodiments, the shell may have a securing member that may be configured to retain a skier's foot within the shell during use but which may be loosened to allow the skier to remove the shell when not skiing. The securing members may for example be straps, buckles or a BOA style ratchet tensioning mechanism.

Cuff

As noted above, by way of at least one embodiment, the cuff is configured to secure to the lower leg of a skier.

The cuff may be secured to the lower leg/shin calf area of a skier.

The cuff may have a securing member that may be configured to retain the cuff to the skier's lower leg/shin calf area during use but, which may be loosened to allow the skier to remove the cuff when not skiing. The securing member may for example be straps, buckles or a BOA style ratchet tensioning mechanism.

While a cuff only type configuration is described, by way of one or more embodiments, the cuff may be defined more widely as the lower leg holding region of the ski boot or an upper part of the ski boot.

Adjustable Damper

The adjustable damper, as noted above, is coupled to the shell and the cuff and is configured to control forward flex or rearward rebound movement of the ski boot, according to one or more embodiments of the invention.

The adjustable damper itself may also be termed a bias mechanism, a suspension mechanism or a shock. These terms and grammatical variations thereof are used collectively herein and, reference to one or the other, is not intended to be limiting unless otherwise specified.

The adjustable damper may be gas, hydraulic or spring driven.

Adjustment of the adjustable damper may be in terms of: return speed (slow/fast), bias strength or resistance to movement, bias range of motion, adjustment of start or a neutral position, adjustment of an end or maximum flex position, and combinations thereof. These adjustments may lead to the above stated changes in the forward flex and the rearward rebound movement characteristics.

Examples of adjustable dampers that may be used to form the ski boot described may comprise: strut dampers (gas driven), spring dampers (air spring or coil spring), suspension dampers, coil over shock dampers, elastomer shock dampers, hydraulic shock dampers, automotive shock dampers, mountain bike shock dampers.

The adjustable damper may be: a pull shock damper, a compression shock damper, a dual ended shock damper (i.e. works in both a tension and compression direction).

The ski boot may comprise one adjustable damper.

The ski boot may comprise more than one adjustable damper.

The ski boot may comprise multiple adjustable dampers. For example, one adjustable damper may be used to control compression damping movement and an alternative adjustable damper may be used to control tension or pull damping or the rebound movement.

Damper Coupling to the Shell and the Cuff

The adjustable damper, shell and cuff may be coupled together in a manner configured to control the forward flex and the rearward rebound movement of the ski boot, according to one or more embodiments of the invention.

Coupling of the cuff, the shell and the adjustable damper may be located about:

- a first pivot axis located about an ankle joint of a skier's foot when the skier's foot is fitted to the ski boot, the first pivot axis configured so that the cuff and shell rotate relative to each other about the first pivot axis;
- a second pivot axis located about and coupling together the cuff and the adjustable damper; and
- a third pivot axis located about and coupling together the adjustable damper and the shell.

In at least one embodiment, a lower portion of the cuff and an upper portion of the shell may be linked together at the first pivot axis about the position of the skier's ankle when the skier wears the ski boot.

Coupling of the cuff and shell about the first pivot axis may be a direct coupling. That is, the cuff and the shell may directly link to each other at the first pivot axis.

Coupling of the cuff and shell at the second pivot axis and the third pivot axis may as noted above be indirect with the adjustable damper linking the shell to the cuff.

The second pivot axis may be located distant to the first pivot axis. The second pivot axis may be located outside of the shell of the ski boot. The second pivot axis may be located generally below the first pivot axis. The second pivot axis may be located in a position that allows sufficient clearance for engagement of a ski binding.

In at least one embodiment, the adjustable damper may be a dual tension and compression adjustable damper. One end of the damper may be coupled to the shell of the ski boot and an opposing end of the adjustable damper may be coupled to the cuff. The point at which the cuff and adjustable damper connect may be the second pivot axis. The third pivot axis may be located where the adjustable damper and shell couple together.

The forward flex may cause rotation of the cuff forwards about the first pivot axis relative to the shell which, in turn causes a distance between the second pivot axis and the third pivot axis to reduce and hence cause a compression force on the adjustable damper.

The rearward rebound movement may cause rotation of the cuff rearwards about the first pivot axis relative to the shell which, in turn causes the distance between the second pivot axis and the third pivot axis to increase and hence cause a tension force on the adjustable damper.

The adjustable damper may be a pull shock damper. In one or more embodiments, forward flex may cause rotation of the cuff forwards about the first pivot axis relative to the shell which, in turn may cause a distance between the second pivot axis and the third pivot axis to increase and hence cause a tension force on the adjustable damper. Rearward rebound movement may cause rotation of the cuff rearwards about the first pivot axis relative to the shell which, in turn may cause the distance between the second pivot axis and the third pivot axis to decrease and hence cause a compression force on the adjustable damper.

The adjustable damper may be mounted on one side or both sides of the ski boot; on a back or heel end of the ski boot; on a toe end or front of the ski boot; or within the ski boot i.e. in the shell of the ski boot or in the cuff of the ski boot, or in a sole of the ski boot.

The cuff, or the shell, or both the cuff and the shell, need not be directly coupled to the adjustable damper. Indirect coupling may occur for example via a cable coupling the cuff or the shell to an end of the adjustable damper.

The first, second or third pivot axis or the pivot axes may be made of pivot bearings. The pivot bearings may have a low clearance. The pivot bearings may be attached to the cuff, or the shell, or both the cuff and the shell.

When the adjustable damper is not coupled to the shell and the cuff, the cuff may rotate relative to the shell with little to no resistance. Expressed an alternative way, all restriction or damping of the forward flex and the rearward rebound movement of the cuff relative to the shell may be removed by disengagement of the adjustable damper.

The first, the second, and the third pivot axes described may transfer rotational movement of the cuff relative to the shell into lateral movement of the adjustable damper.

The cuff may be configured to rotate forward and aft around the pivots as forward flex and rearward rebound movement occurs.

Lateral and vertical stiffness of the ski boot may be designed/engineered into the pivot axes, the shell, the cuff and the adjustable damper arrangement.

The adjustable damper may be coupled to the shell and the cuff in three distinct modes:

- Race mode where the adjustable damper may be permanently fixed to the shell and the cuff. The adjustable damper may not be removed while in use without tools. This mode may be designed for the highest of ski performance;
- Slouch touring mode where the adjustable damper may be detached from either the shell or the cuff but not entirely removed from the ski boot. This mode may be useful for ski touring or, for comfort when not skiing;
- Full touring mode where the adjustable damper may be detached from the cuff and the shell to remove weight of the adjustable damper from the ski boot. This mode may be useful for ski touring or, for comfort when not skiing.

Sensor

As noted above, by way of one or more embodiments, the ski boot comprises a measuring sensor that collects data about the forward flex and the rearward rebound movement of the ski boot.

The sensor may be configured to store, transmit or, store and transmit, the sensed data of the forward flex and the rearward rebound movement during use of the ski boot.

The sensor may measure the forward flex and the rearward rebound movement indirectly by measuring movement of the adjustable damper.

The sensed data of the forward flex and the rearward rebound movement may be measured by sensing: range of motion (ROM) and/or speed of motion and/or acceleration forward and aft of the cuff relative to the shell.

The sensor may sense movement of the cuff and may be configured to store, transmit or, store and transmit, measured movement data collected about movement of the cuff during use of the ski boot.

Multiple sensors may be used and not a single sensor. Reference to a singular sensor, unless otherwise stated, should not be seen as limiting and also encompasses multiple sensors.

The sensor (or sensors) may be one or more rotational sensors. The rotational sensor or sensors may be located on or about the pivot axis or axes. The rotational sensor or sensors may be located in or on the cuff or a part thereof.

The adjustable damper itself may be digitized and adjustable damper travel may be used as the sensor. Digitized adjustable dampers exist in the art in cycling applications and may be modified for use in the context of a ski boot to provide the forward flex and the rearward rebound movement characteristics.

The sensor or sensors may also sense the forward flex and the rearward rebound characteristics via cables or strain gauges.

The ski boot or sensor may further comprise a signaling means that communicates sensed data collected from the sensor as a communicated signal. The communicated signal may be received by a processor. The communicated signal may be a wireless signal. The processor may be a smartphone, laptop or other device.

Sensed data may be stored on the ski boot.

The sensed data could be analyzed via an application on the processor and the adjustable damper then automatically adjusted or recommendations made to the user to manually adjust the adjustable damper. Recommendations for adjustment may be presented to the skier via their processor.

Means to Adjust the Adjustable Damper Movement.

As noted above, in one or more embodiments, the ski boot may comprise a means to adjust the adjustable damper in response to the sensed data provided by the sensor.

The adjustable damper may control the forward flex and the rearward rebound movement by controlling characteristics selected from: an extent of the forward flex and the rearward rebound movement; a speed of the forward flex and the rearward rebound movement; an acceleration of the forward flex and the rearward rebound movement; and combinations of these characteristics.

Adjustment of the adjustable damper may be achieved by adjusting the adjustable damper: return speed, bias strength or resistance to movement, bias range of motion, adjustment of start or a neutral position, adjustment of an end or maximum flex position, and combinations thereof.

The forward flex and the rearward rebound movement damping may be adjusted by increasing or decreasing the amount of air or fluid or element (such as nitrogen) within the adjustable damper.

The rearward rebound movement damping may be adjusted via a valve within the adjustable damper. The rebound may be adjusted from fast to slow or vice versa.

The adjustable damper may be adjusted manually or automatically.

Adjustment of the adjustable damper may be completed using, for example, mechanical servos, magnetic valves, by manually adding air via a shock pump, or by screwing open or closing valves that effect dampening.

Adjustment may be to make the boot more flexible by increasing the range of flex controlled by the adjustable damper. Forward flex and range of motion may for example be increased by reducing the damping forces provided by the adjustable damper.

Adjustment may be to increase the boot stiffness by decreasing the range of flex controlled by the adjustable damper. Forward flex and range of motion may for example be decreased by increasing the damping forces provided by the adjustable damper.

Timing of Adjustment

Adjustment of the adjustable damper movement may occur during use of the ski boot.

The adjustable damper may be adjusted manually.

The adjustable damper may be adjusted automatically.

For example, the ski boot is not like a traditional ski boot where characteristics of forward flex and rebound are inherent to the ski boot design and not adjustable or only adjustable using tools which is generally completed at a ski retail outlet.

The above described ski boot may be adjusted between ski runs or when the skier stops part way through a ski run. The ski boot may adjust itself automatically in response to sensed information about the forward flex and the rearward rebound movement of the ski boot.

Sensing of sensed data and adjustment of the adjustable damper may occur at an instant of time. Sensing of sensed data and adjustment of the adjustable damper may occur over a time period.

Damper Apparatus Disengagement

The adjustable damper may be configured to be disengaged from the shell, or the cuff, or both the shell and the cuff. When the adjustable damper is disengaged, the cuff may rotate relative to the shell with little to no resistance.

When disengaged, the cuff and shell are no longer controlled in regards to forward flex and rearward rebound movement. Once disengaged, the cuff may move in an unrestrained manner relative to the shell. This may be useful as noted above for ski touring modes of use.

Constant Compression Force and Rebound

The compression force and rebound speed (tension force) of the adjustable damper does not change if the ski boot neutral forward lean angle is increased or decreased i.e. by using alternative shell or cuff shock mounts, the neutral forward lean angle of the ski boot can be adjusted forward and aft without inducing any compression or tension forces on the damper.

By contrast, traditional over lapping plastic ski boots do increase or decrease the force and rebound speed of the boot when the forward lean angle is increased or decreased from the neutral position. This is an inherent limitation of the traditional overlapping plastic ski boot.

Liner

The ski boot may further comprise a liner.

The liner may be removable from the shell and the cuff.

The liner may fit inside at least the shell. The liner may fit inside both the cuff and the shell. The liner may keep the lower leg warm.

The liner may also provide padding between the skier's lower leg and the cuff and shell of the ski boot.

The liner may be articulated. Articulation may be to allow for easy range of motion of the lower leg.

Gaiter

The ski boot may further comprise a water resistant gaiter.

The gaiter may be attached to the cuff and/or the shell. The gaiter may be removably attached to the cuff and/or the shell. The gaiter may be independent to the liner if used.

The gaiter may be used resist or prevent moisture from entering the cuff, the shell and the liner if used. The gaiter, if used, may be configured to not interfere with lower leg movement.

Materials

The shell and the cuff of the ski boot may be made from a variety of semi rigid or rigid materials. It is envisaged that the shell and cuff may be made from materials familiar to skiers. Examples of materials that may be used to form the cuff and the shell may include: polyurethane, polyamide, polypropylene, carbon fiber, and combinations thereof.

A System

In one or more embodiments, there is provided a system comprising:

- a ski boot configured to control and adjust a forward flex and a rearward rebound movement of a ski boot while the ski boot is in-use, the ski boot comprising:
  - a shell configured to receive and retain a foot of a skier;
  - a cuff configured to secure to a lower leg of a skier;
  - an adjustable damper, the adjustable damper coupled to the shell and the cuff, the adjustable damper configured to control the forward flex and the rearward rebound movement of the ski boot;
  - a sensor measuring sensed data about the forward flex and the rearward rebound movement of the ski boot; and
  - means to adjust the adjustable damper in response to the sensed data provided by the sensor;
- a processor that receives and analyses the sensed data while the ski boot is in use; and
- a receiver that receives a signal from the processor and which, via the means to adjust the adjustable damper, adjusts the adjustable damper to alter the forward flex and the rearward rebound movement of the ski boot.

Processor

The processor may be a mobile phone, tablet, computer or other device. The processer may be a smartphone.

The processor may gather the sensed data from the sensor around the forward flex and the rearward rebound movement.

The processor may assimilate other ski data relating to the skier in addition to the sensed data and the other ski data may be linked to the sensed data received from the ski boot.

For example, in at least one embodiment, the other ski data may be selected from: number of days skied per year, number of ski runs per day, difficulty of ski runs, locations skied by resort, town and country. This other ski data may be linked to the sensed ski data received from the ski boot.

The other ski data may also comprise measuring speed/position using for example, a GPS sensor. This speed/position data could allow analysis of a particular route/run. For racing applications a skier could test different damper settings and see their effects on performance.

The other ski data may also be non-real-time adjustment data. For example, in at least one embodiment, the initial set-up for a location/ski session may be derived from other ski data selected from: personal historical data, location weather, location ski conditions, crowd-sourced information such as other people's inputs/outputs in the same location/conditions.

The sensed data sensed and assimilated together may be used to build a profile of an individual skier. This profile may be paired with product recommendations to best suit the skier or used to alter ski equipment settings.

The sensed data may be used by a ski retailer to match ski equipment to individual users based on historical in-use data.

The sensed data could identify when an individual has endured extreme range of motion movement, speeds and or forces which are the precursors to serious accidents and injuries. This information could be used to mobilize a medical response or a search and rescue. The information could be used to build profiles around what forces induce what injuries and or provide some evidence as to if an injure actually occurred while skiing at a specific resort or area.

Timing of Processing/Adjustment

The sensed data may be transmitted when pulled from the processor at a moment of time.

The sensed data may be transmitted continuously to the processor over a time period.

Signal transmission of the sensed data sensed from the ski boot during use may occur in real time while the skier is skiing.

Signal transmission of the sensed data may occur in at an instant of time. For example, in one or more embodiments, the sensed data may be transmitted at specific moments while the skier is skiing e.g. every 15, 30, 45 or 60 seconds. Measurement and transmission may occur multiple times a second. In one example, by way of at least one embodiment, measurement and transmission may occur up to 1000 times per second. The sensed data may be transmitted when pulled by the processor from the sensor at a moment of time. For example, in at least one embodiment, the skier may complete a ski run and using their smartphone and an app thereon, request the sensed data to be transmitted to their smartphone, the sensed data being collected up to the moment of transmission to the smartphone.

Transmission of the sensed data may occur over a period of time. For example, in one or more embodiments, the sensed data may be transmitted continuously over a time period while the skier is skiing e.g. over a time period of 15, 30, 45 or 60 seconds, or 1, 5, 10, 15, 30, or 60 minutes, or 1, 2, 3, 4, 5, 6 hours, or over 1, 2, 3, 4, 5, 6, or 7 days.

Adjustment of the adjustable damper to change forward flex and rearward rebound movement may occur in real time while the skier is skiing.

Adjustment of the adjustable damper may occur at a moment of time e.g. when the skier completes a ski run and after the processor analyses the sensed data and sends a signal to adjust the adjustable damper.

Damper Adjustment

Adjustment of the adjustable damper in response to the sensed data may occur in real time while the skier is skiing.

Alternatively, by way of one or more embodiments, adjustment of the adjustable damper in response to the sensed data may occur at a moment of time.

The system may automatically alter the adjustable damper function. For example, in at least one embodiment, the system may automatically alter the adjustable damper to correspondingly adjust the forward flex and the rearward rebound movement in response to the sensed data.

The system may alternatively provide recommendations to the skier for the skier to manually adjust the adjustable damper. For example, in at least one embodiment, the system may provide a recommended range of motion or rebound speed for the skier to then adjust the adjustable damper accordingly to meet the recommended range or speed.

Additional Data Uses

The system may provide further ski data information to the skier.

The system may advise a skier to change a characteristic of the adjustable damper as a skier gains or loses strength or, alternatively, improves or loses their technique. This may be over time such as between ski seasons, or during a season of skiing.

The system may identify and then notify a skier that they are becoming fatigued. The system may identify user fatigue for example based on: the number of runs, the forces that are being generated, the number of days skied consecutively, the skiers historical data and noted changes in forces generated during a day's skiing.

The system may advise a skier to set up their ski boots different from each other i.e. left boot different to a right boot. This variation may be due to injury, lack of mobility, deformity, muscle unbalance and or an inconsistent ski technique.

The system may advise a user of the best compression force for different snow conditions such as: hard on piste snow versus soft off piste snow or other snow condition.

The system may advise a user of the best rebound speed for different snow conditions such as: hard on-piste snow vs soft off-piste snow or other snow condition.

The system may advise a user of the best compression forces and rebound speeds for different ski turn radius: short fast turns on hard smooth snow versus wide long turns on hard smooth snow e.g. slalom ski racing turns vs downhill ski racing turns.

Advantages

Selected advantages of the above ski boot and system, by way of one or more embodiments, may be as follows below.

- Range of Motion—Data in respect of ROM (range of motion forward and aft) and the speeds/velocity of that motion may be captured statically (not skiing on snow) but is best captured and applied while in-use (skiing on snow) to get a true sense of what is actually occurring whilst skiing. The described ski boot and system may provide data measurement in-use while skiing on snow hence, may allow for the best possible set up and tuning of the ski boot and system;
- Tailored Set Up—The ski boot and system described allows the ski boot to be specifically tuned to a particular skier, ski terrain, snow conditions, or ski course e.g. an Olympic ski race or a world cup FIS event;
- Personalization—The instrumentation may personalize ski boots to meet the exact needs of individual skiers over a long time period. For example: over a full ski season; over many years of skiing; whilst recovering from injuries; over a time period of changing ski styles from improvements through instructions (coaching): over a time period spent in changing snow conditions; for ski locations (northern and southern hemisphere snow conditions and air temperatures can vary greatly);
- Setting Prediction—Prior to on snow use, the system may be used, for example in a retail/shop setting, to predict optimal settings for a skier based on inputs including: weight, height, the user's range of lower leg motion, preferred ski terrain type, snow conditions, skiing style, and, to then recommend ski binding DIN's and/or recommended ski stiffness or flex pattern;
- Customized Adjustment by Retailers—The ski boot described may allow a ski retail or rental shop to adjust or change the users equipment (boots, bindings and skis) to best meet that users' needs based on in-use data. This avoids using indirect or subjective measures to determine boot flex such as collating an individual's age, height, weight and claimed skiing ability information;

Damping Under Load—The ski boot and system may provide damping or flexion under load;

Provision of an Objective Measure—The ski boot and system may provide an objective basis for adjustment of the damping or flexion of the boot to suit an individual or conditions;

Ski Field Data Capture—The ski boot and system (and other such as GPS tracking) may provide feedback to both the skier and ski field operators regarding how individuals ski a particular ski field, on a particular ski run, on a particular day and in selected snow conditions. The sensed data may be used to open/close or manage or advise operators and users on dangerous ski areas based on the sensed data captured;

Audience—The ski boot and system may be desirable for elite skiers and enthusiasts who like the ability to adjust their ski boots for different terrain, ski styles (on vs off piste skiing) and different snow conditions;

Disengagement—The adjustable damper may be disengaged and removed allowing for frictionless walking or ski touring. Typically, traditional ski touring boots have some overlapping plastic which results in some resistance to walking and ski touring;

Avoidance of Flex Rating Compliance—The ski boot described may eliminate the need for manufacturers to make ski boots with different flex ratings. The ski boots described may be capable of offering many, or an infinite, range of damping hence may lead to a reduction in compliance, manufacturing cost and mis-information. Additionally, avoiding reference to a non-standardized flex rating may be useful. The current ski boot flex rating system used by the ski industry is not related to any standardization. Currently consumers must rely on ski boot fitters' subjective recommendations when purchasing ski boots to choose the correct ski boot flex for each user. The ski boot described herein may replace the incumbent and inaccurate ski boot flex rating system with a ski boot and system tailored to an individual and the changing snow conditions and ski styles in which they ski;

Injury Prevention or Reduction—Correct ski boot fitting and tuning may lead to a reduction in injuries and associated costs and liabilities. A dampened ski boot such as that described may reduce acceleration forces at the knee and may hence reduce the likelihood of knee injuries;

Static Compression Force and Rebound Speed—The ski boot and system described may prevent the compression force and rebound speed of the adjustable damper changing if the ski boot neutral forward lean angle is increased or decreased. This is something that no traditional (overlapping plastic) ski boot can achieve;

Air Temperature Independence—Changes in air temperature may not affect the performance of a gas/hydraulic shock powered ski boot as much as it does affect the performance of a traditional plastic ski boot. Plastic ski boots become firmer in cold conditions and softer in warm conditions. The ski boot characteristics that a skier would experience while trying on the ski boot described above in a retail shop is what the skier will feel when skiing in the colder conditions of the ski field. This is not the case for traditional ski boots;

High Performance—A ski boot and system as described above is envisaged to be able to be skied faster than a traditional ski boot which has implications for the Olympics, world cup racing and other high performance ski events. At the very least, at an elite level, the added data from the ski boot and the system described may lead to greater consistency in performance and potentially improve the users performance;

Negative travel—The ski boot and the system described may be designed to have controlled rebound or negative (rearward) travel from the ski boots neutral forward lean angle. Controlled rebound from negative travel may be beneficial when skiing park, big mountain or freestyle events where a small amount of negative rearward rebound movement travel may assist when landing multiple jumps in a back seat/unbalanced position. This may also help to prevent injuries. The negative rebound travel may also assist a user to regain their posture/balance and perform to a higher level;

Performance validation—the sensed data produced from the ski boot and the system described may be used to validate a skiers ski style, their performance, and changes made to their technique accordingly.

One or more embodiments of the invention may also be said broadly to consist in the parts, elements and features referred to or indicated in the specification of the application, individually or collectively, and any or all combinations of any two or more said parts, elements or features, described herein.

Further, by way of at least one embodiment, where specific integers are mentioned herein which have known equivalents in the art to which the embodiments relate, such known equivalents are deemed to be incorporated herein as if individually set forth.

WORKING EXAMPLES

The above described ski boot and system are now described by reference to specific examples and the items and numbering listed below:

1 Ski boot
2 Forward flex direction
3 Rebound direction
4 Shell
5 Cuff
6 Adjustable damper
7 Sensor
8 Toe or front end of shell
9 Heel or rear end of shell
10 Base
11 Securing members shell or cuff
12 First pivot axis
13 Lower portion of the cuff
14 Upper portion of the shell
15 Second pivot axis
16 First end of the damper coupled to the shell
17 Opposing end of the damper coupled to the cuff
18 Third pivot axis
19A Damper reservoir
19B Damper shaft
$F_c$ Compression direction
$F_{ex}$ Extension direction
20 Metal cuff
30 Shell/foot Liner
40 Calf liner
50 Shin protector
100 System
110 Processor
120 Signal of ski boot data
130 External ski data
140 Skier profile
150 Signal to adjust the adjustable damper

200 Left boot ROM
300 Right boot ROM
400 Left knee acceleration
500 Right knee acceleration Example 1

By way of one or more embodiments, FIGS. 1-5 show an example of a ski boot 1 described above. The ski boot 1 shown in the Figures is a combination of an existing ski boot 1 shell 4 with an exoskeleton cuff 5 (upper). The cuff 5 movement relative to the shell 4 is controlled by an adjustable damper 6 being a compression shock in this example. The white wiring shown about the ski boot 1 ankle joint is a rotational sensor 7 that is connected to a data logger. The ski boot 1 original liner is cut off at the ankle to remove any resistance to forward and aft lower leg motion. It should be appreciated that the demonstrated ski boot 1 in this example is a proof of concept ski boot 1 and not a final product used to show ski boot 1 operation.

In more detail, according to one or more embodiments of the invention, the ski boot 1 comprises a shell 4 configured to receive an retain a foot of a skier (not shown); a cuff 5 configured to secure to the lower leg of a skier; and an adjustable damper 6. Movement of the cuff 5 relative to the shell 4 is controlled in a forward flex direction 2 and a rebound direction 3.

Figure 5:
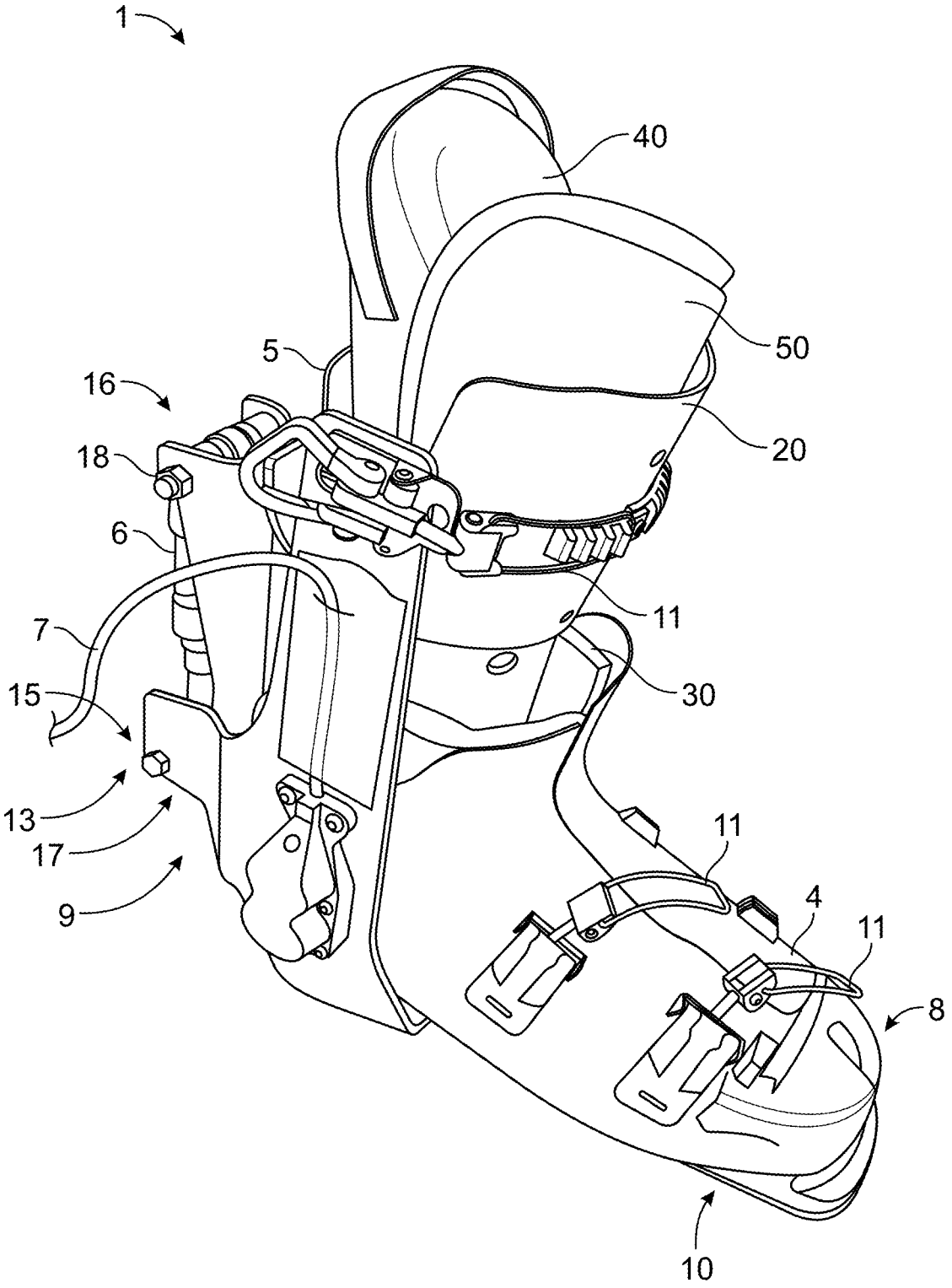
FIG. 5 is a drawing if the ski boot assembled together, according to one or more embodiments of the invention.

As best seen in FIG. 5, by way of at least one embodiment, the adjustable damper 6 is coupled to the shell 4 and the cuff 5.

The adjustable damper 6 may be adjusted manually or automatically in response to sensed data measured by the sensor 7.

The shell 4 has a shoe shape and form with a base 10 that a foot stands on and an enclosure over the foot of a skier. The shell 4 has a toe or front end 8, a heel or rear end 9 and sides. The shell 4 may have straps 11, buckles or a BOA style ratchet tensioning mechanism.

The cuff 5 secures to the lower leg of a skier. The cuff 5 may be secured using straps 11, buckles or a BOA style ratchet tensioning mechanism.

The adjustable damper 6 is coupled to the shell 4 and the cuff 5. In the Figures shown, by way of one or more embodiments, the adjustable damper 6 is a dual direction gas or spring driven shock. Adjustment may be in terms of return (slow/fast), bias strength or resistance to movement, bias range of motion. These adjustments lead to the above stated changes in forward flex 2 and rebound 3 characteristics. While one adjustable damper 6 is shown in the Figures located at the rear 9 of the ski boot 1, multiple adjustable dampers (not shown) may be used. Further, the one or multiple adjustable dampers may be located elsewhere about the ski boot 1.

Coupling of the cuff 5 and shell 4 shown in the Figures is located about the ankle joint of a skier's foot when fitted to the ski boot 1 The cuff 5 and shell 4 may rotate relative to each other about a first pivot axis 12 and this first pivot axis 12 is located about the position of the skier's ankle. The cuff 5 and the shell 4 are also coupled together via a second pivot axis 15 located distant to the first pivot axis 12. The second pivot axis 15 is located outside of the shell 4 of the ski boot. One end of the adjustable damper 6 is coupled to the shell 4 of the ski boot 1 at an upper extending portion of the shell 4. An opposing end of the adjustable damper 6 is coupled to the cuff 5 about a lower portion 13 of the cuff 5. The point at which the cuff 5 and adjustable damper 6 connect is the second pivot axis 15.

A third pivot axis 18 is located where the adjustable damper 6 and the shell 4 couple together. This may allow the adjustable damper 6 to rotate slightly as rotation occurs between the cuff 5 and shell 4.

Figure 6:
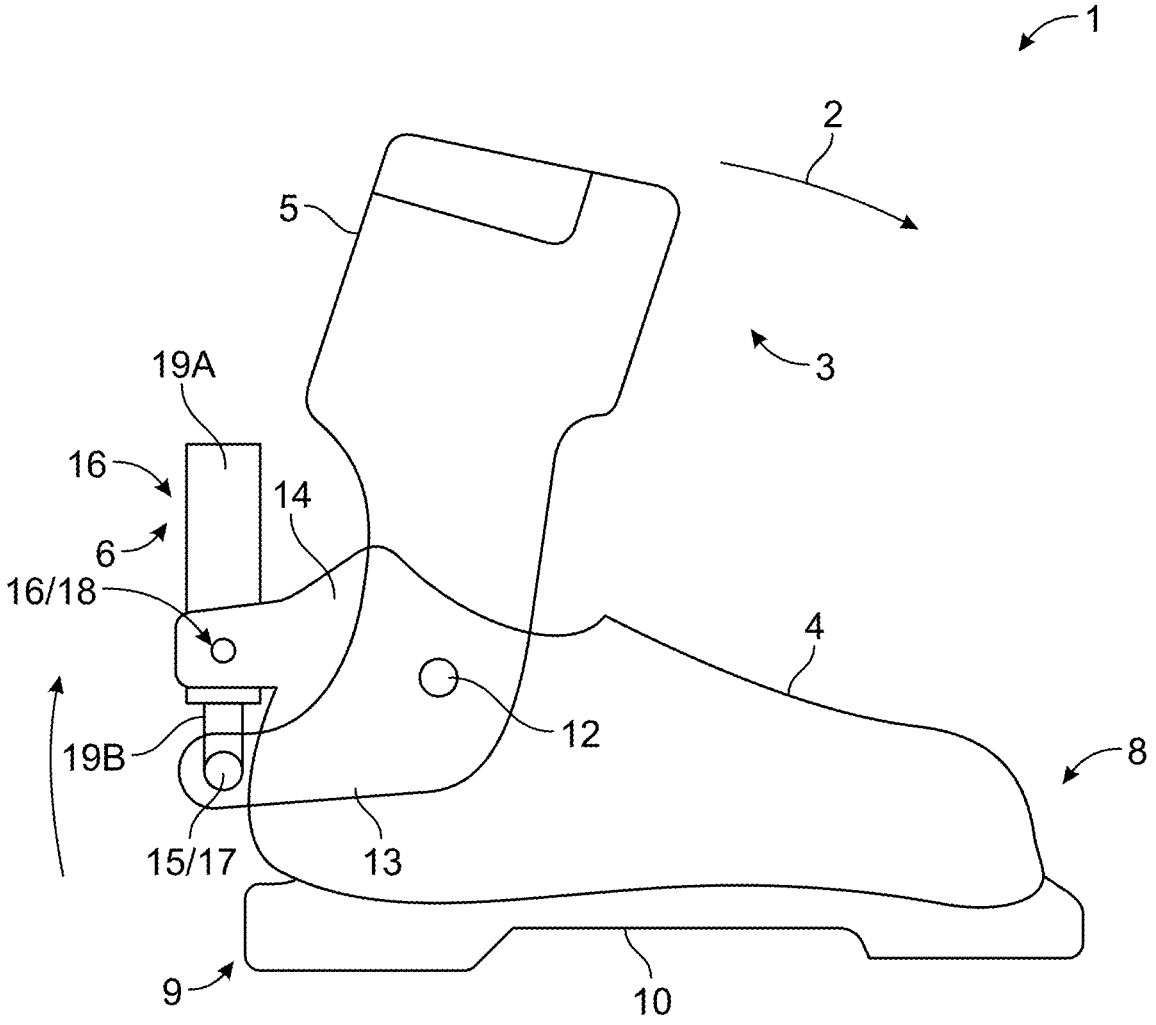
FIG. 6 illustrates a schematic side view of the ski boot using a compression shock damper with the shock attachments located at the end of the shock shaft and at the base of the damper reservoir, according to one or more embodiments of the invention.
Figure 7:
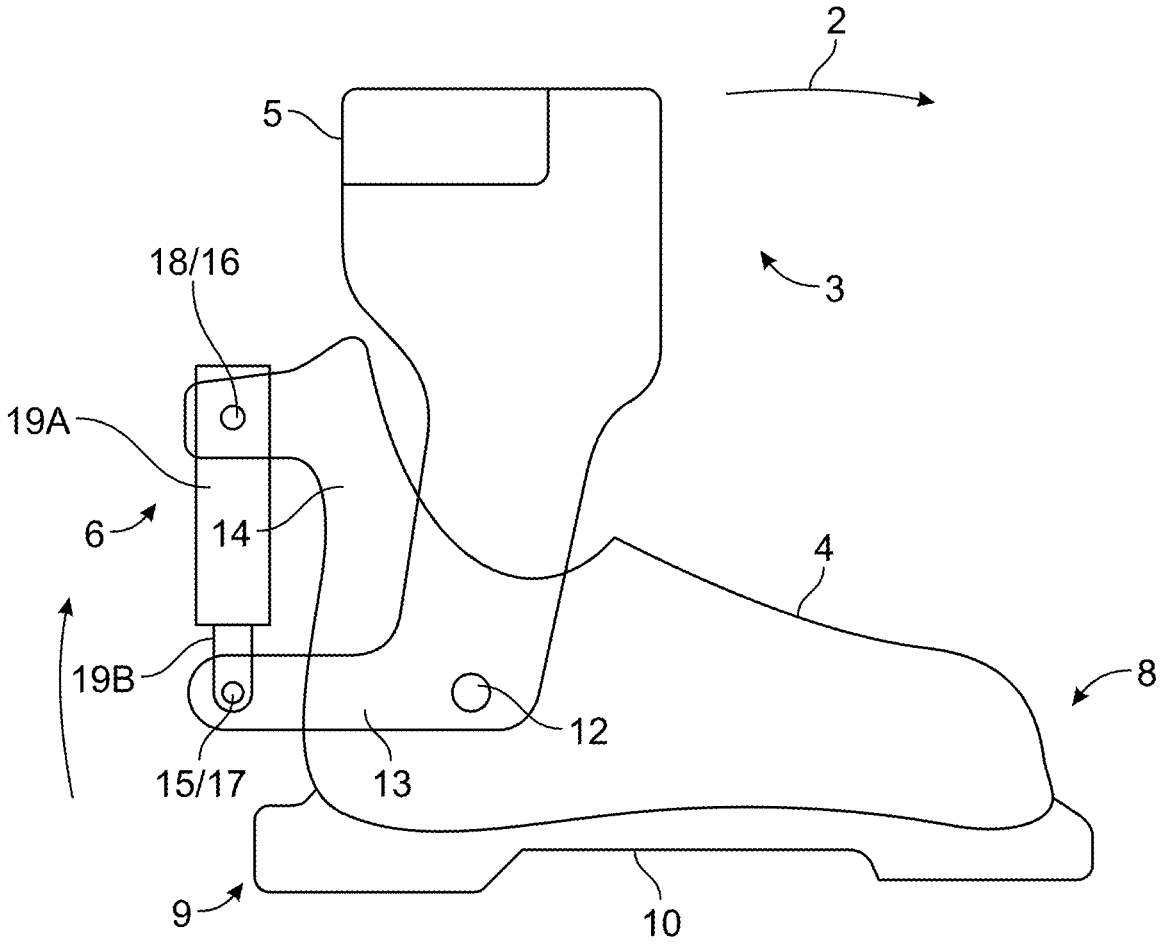
FIG. 7 illustrates a schematic side view of the ski boot using a compression shock with the shock attachments at both ends of the shock, according to one or more embodiments of the invention.
Figure 8:
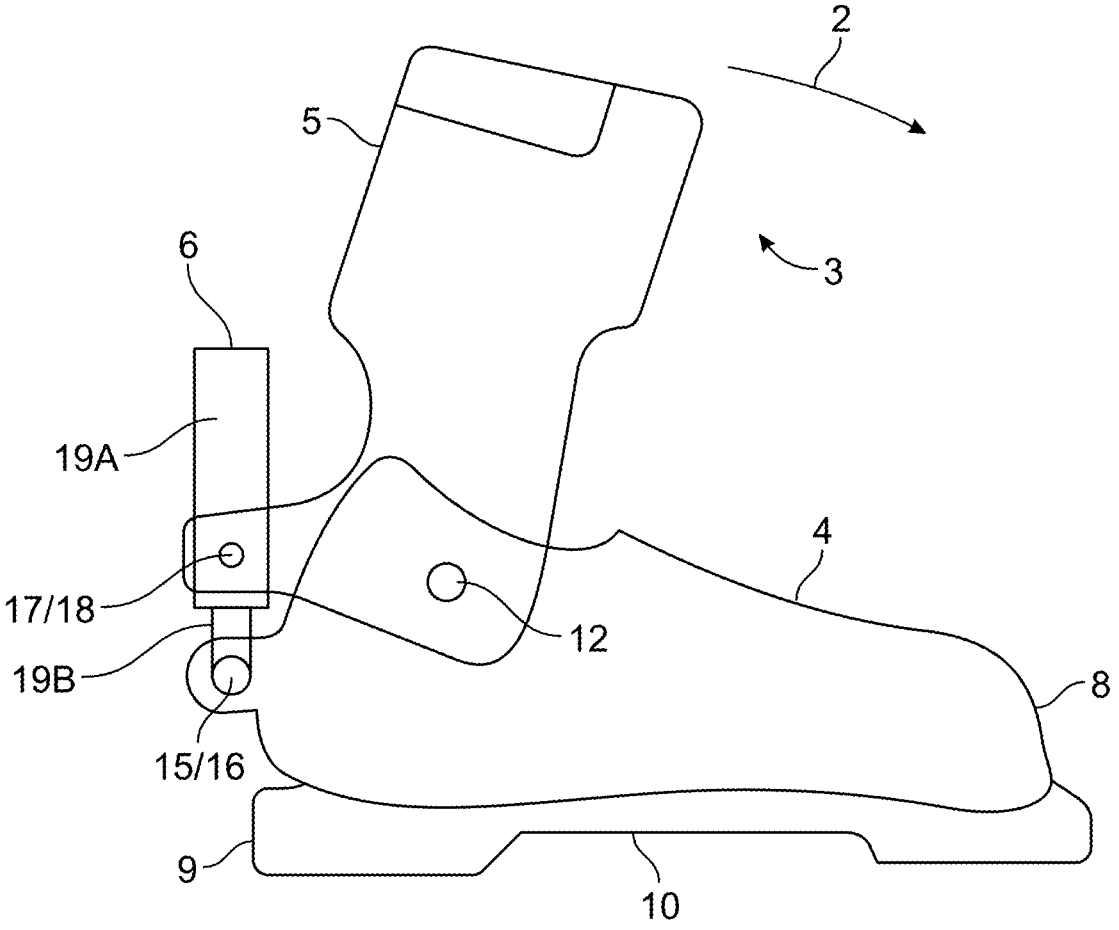
FIG. 8 illustrates a schematic side view of the ski boot using a pull shock with the shock attachments located at the end of the shock shaft and at the base of the damper reservoir, according to one or more embodiments of the invention.

FIG. 6, according to one or more embodiments, shows a slightly different damper 6 arrangement to FIGS. 1-5. In FIG. 6, in at least one embodiment, a compression shock 6 is still used but, in this case, the shock 6 attachments are at the end 17 of the shock 6 shaft 19B and at the base 16 of the damper reservoir 19A. FIG. 7, in one or more embodiments, shows the damper 6 orientation of FIG. 5 again being a compression shock 6 with attachments 16, 17 at either end of the shock 6. FIG. 8 shows an alternative damper 6 arrangement using a pull shock 6 with the shock 6 attachments 16, 17 located at the end of the shock 6 shaft 19B and at the base of the damper reservoir 19A, according to one or more embodiments of the invention.

As shown in FIGS. 6,7 and 8, forward flex movement 2 by the skier may result in cuff 5 movement forwards towards a toc end 8 of the shell 4, according to one or more embodiments of the invention. This cuff 5 movement causes rotation about the first pivot axis 12 relative to the shell 4 which in turn causes the distance between the second pivot axis 15 and the third pivot axis 18 to reduce (or increase in FIG. 8 for a pull shock), and hence cause compression motion (tension in FIG. 8) on the adjustable damper 6.

As rebound movement 3 occurs, the cuff 5 is drawn rearwards or aft relative to the toc end 8 of the shell 4 and, in doing so, causes rotation of the cuff 5 relative to the shell 4 about the first pivot axis 12, in turn also causing tension (or compression in FIG. 8) movement on the adjustable damper 6 as the distance between the second pivot axis 15 and the third pivot axis 18 increases (or decreases in FIG. 8).

A metal cuff 20 is also shown in FIGS. 1-5, according to one or more embodiments of the invention. This metal cuff 20 is used in this prototype design to hold the skiers' leg within the sides of the cuff 5. A shin protector 50 is also shown in FIGS. 1-5, according to one or more embodiments of the invention, located about the skiers' shin when worn. A shell/foot liner 30 is shown cut down to the ankle area. A calf liner 40 is used to protect the calf muscle from the hard metal cuff 5.

Figure 9:
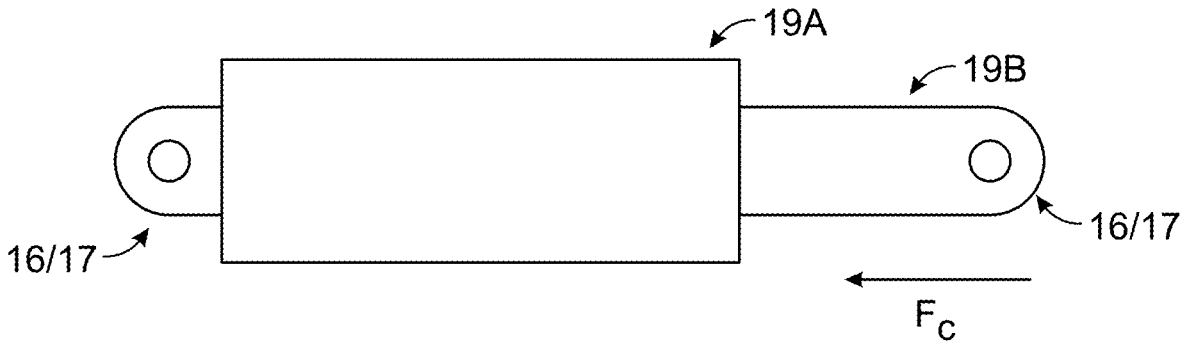
FIG. 9 illustrates a schematic side elevation view of a compression shock showing shock attachment points at both ends of the shock, according to one or more embodiments of the invention.
Figure 10:
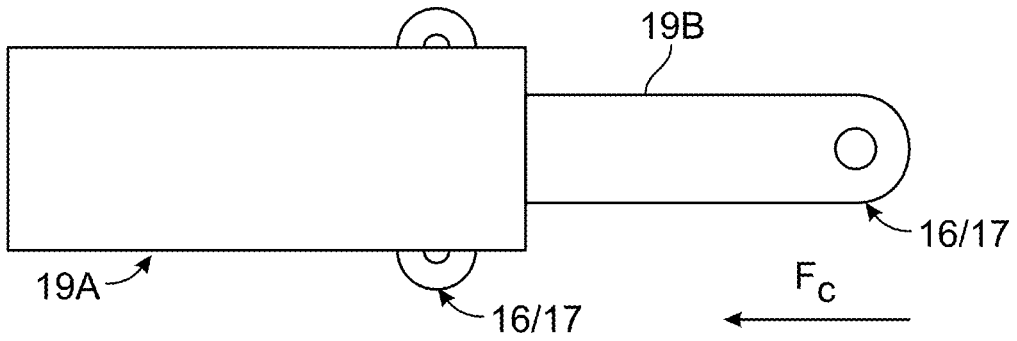
FIG. 10 illustrates a schematic side elevation view of a compression shock showing shock attachment points at the shaft end and at the base of the damper reservoir, according to one or more embodiments of the invention.
Figure 11:
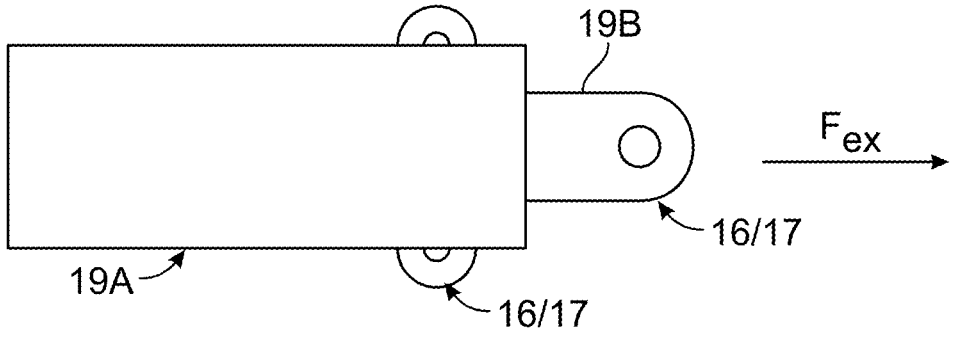
FIG. 11 illustrates a schematic side elevation view of a pull shock showing attachment points at the shaft end and at the base of the damper reservoir, according to one or more embodiments of the invention.
Figure 12:
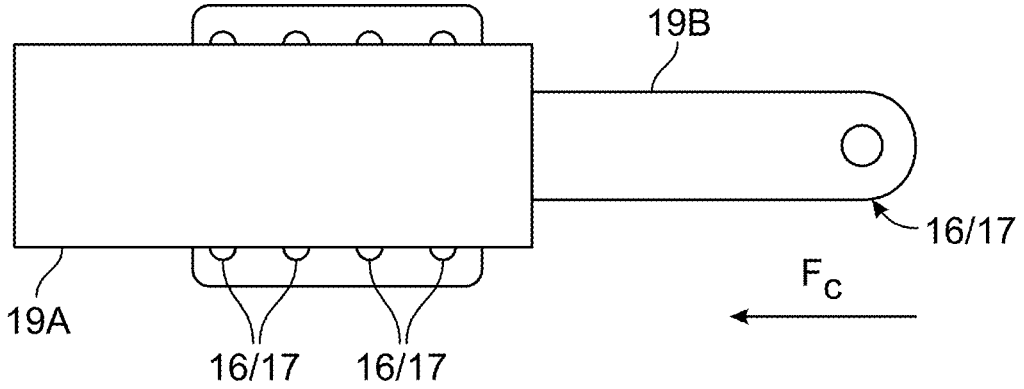
FIG. 12 illustrates a schematic side elevation view of a compression shock showing shock attachment points at the shaft end and at multiple positions on the damper reservoir sides, according to one or more embodiments of the invention.

FIGS. 9-12 illustrates some additional damper 6 arrangements, according to one or more embodiments of the invention. FIG. 9 shows an end to end compression shock 6 with mount locations 16, 17 on either end of the damper reservoir 19A, one end on the end of a shaft 19B extending from the damper reservoir 19A and the other end on the outer side of the damper reservoir 19A distal to the shaft 19B end. FIG. 10 shows a compression shock 6 with a first attachment point 16, 17 at one end of the shaft 19B and one or more attachments 16, 17 on the sides of the damper reservoir 19A. FIG. 11 shows a pull shock 6 arrangement with attachment points 16, 17 on the shaft 19B end and sides of the damper reservoir 19A. FIG. 12 shows a further alternative compression shock 6 with a first attachment point 16, 17 at one end of the shaft 19B and multiple attachments 16, 17 on the sides of the damper reservoir 19A. In this case, various alternative attachment points provided on the side of the damper reservoir may be used to allow for changing the neutral forward lean angle of the ski boot. The same approach of having multiple attachment points may be used for the other examples shown in FIGS. 9-11 e.g. multiple openings in the damper shaft 19B for different attachment points.

Example 2

Figure 13:
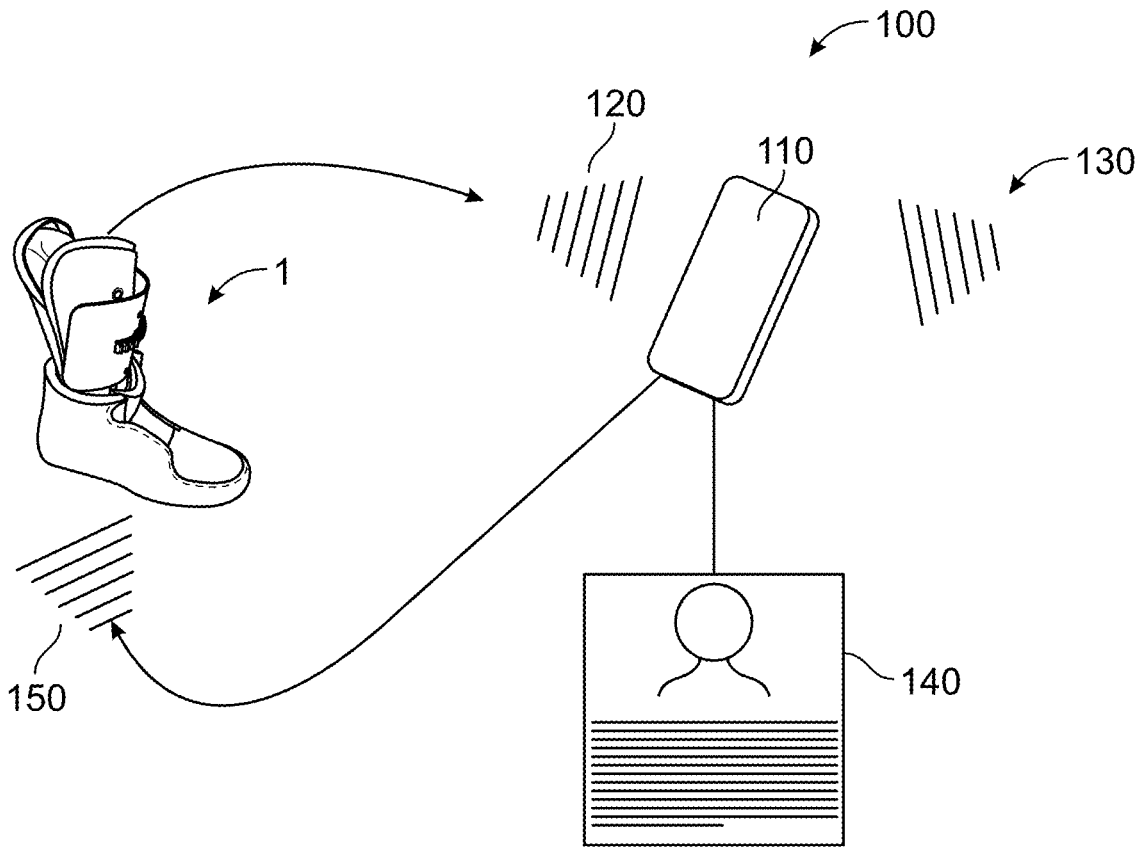
FIG. 13 illustrates an example system using the ski boot, according to one or more embodiments of the invention.

A system 100 using the ski boot 1 is now described with reference to FIG. 13, according to one or more embodiments of the invention.

The system 100 may comprise the above ski boot 1 and a processor 110 that receives and analyses sensed adjustable damper movement 120. This may be sensed and sent while the ski boot 1 is in use; a receiver 150 that receives a signal from the processor 110 and which, via the means to adjust the adjustable damper 6, adjusts the adjustable damper 6 movement.

The processer 110 may be a smartphone. The processor 110 may gather ski data 120 from the ski boot 1 around forward flex 2 and rebound 3 along with other sensed characteristics as may be sensed. For example, the processor 110 may assimilate external ski data 130 relating to the skier such as: number of days skied per year, number of ski runs per day, difficulty of ski runs, locations skied by resort, town and country. This other ski data 130 may be linked to the sensed ski data 120 received from the ski boot 1 by the processor 110.

The ski data 120, 130 may be used to build a skier profile 140 for an individual skier. This profile 140 may be paired with product recommendations to best suit the skier or used to alter ski equipment settings.

Signal transmission of ski data 120 sensed from the ski boot 1 may occur in real time while the skier is skiing at an instant of time or over a period of time.

The system 100 may automatically alter adjustable damper function. For example, the system 100 may automatically alter the adjustable damper 6 forward flex 2 or rebound 3 characteristics in response to the sensed ski data 120, 130 and 140. The system 100 may alternatively provide recommendations to the skier for the skier to manually alter the adjustable damper 6 function.

Example 3

In this example, trial ski runs were completed using the above described boot, ski data collected on range of motion (ROM), according to one or more embodiments of the invention. The ROM was then used to change the shock settings i.e. an increase or decrease in the forward compression is equivalent to a decrease or increase in ROM. An increase in the rebound dampening is equivalent to a higher average ROM with a condensed ROM spread.

Figure 14:
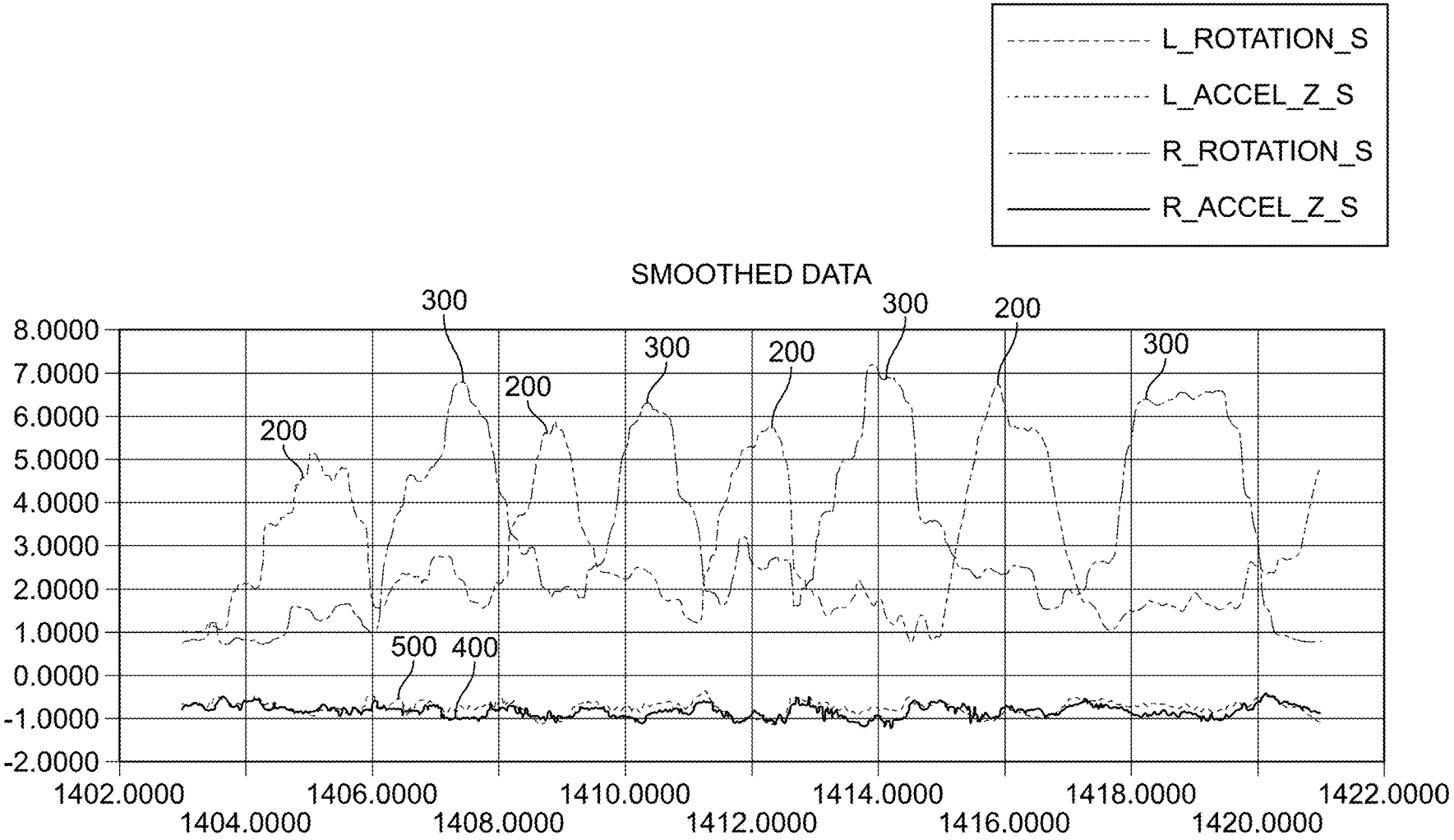
FIG. 14 illustrates an example of range of motion (ROM) data that may be obtained from the ski boot during use, according to one or more embodiments of the invention.

FIG. 14 shows the instrumented data that was captured from a left and a right shock powered ski boot, according to one or more embodiments of the invention. The data shows the left and right boot undertaking eight short carving turns while being skied on piste. The Y axis shows the ROM measured in degrees. In the trial, the boots ROM travelled from 0.8 to 7.3 degrees during the eight ski turns. The X axis shows the time measured in seconds. The start time is 1402.5 seconds from when testing began and the finish time is 1420.5 equating to a trial duration of 18 seconds. This is a snap-shot of the data that may be continuously streaming during a test day.

The left and right boot in FIG. 14 are identified by color (darker line 200 and lighter line 300), according to one or more embodiments of the invention. The lines 400, 500 at the base of the graph show acceleration at the left and right knee to illustrate how additional sensors may be added to obtain additional data.

Aspects of the ski boot and system, according to one or more embodiments of the invention, have been described by way of example only and it should be appreciated that modifications and additions may be made thereto without departing from the scope of the claims herein.

What is claimed is:

1. A ski boot configured to control and adjust a forward flex and a rearward rebound movement of the ski boot while the ski boot is in-use, the ski boot comprising:

a shell configured to receive and retain a foot of a skier;

a cuff configured to secure to a lower leg of the skier;

an adjustable damper coupled to the shell and the cuff, wherein the adjustable damper is configured to control the forward flex and the rearward rebound movement of the ski boot while the ski boot is in-use;

a sensor configured to measure sensed data comprising forward flex and the rearward rebound movement of the ski boot about at least one pivot axis, wherein the sensor is a rotational sensor located on or about the at least one pivot axis and wherein the sensed data is measured by sensing a range of motion (ROM) of the cuff relative to the shell;

a processor configured to receive the sensed data and analyze said sensed data while the ski boot is in-use communicated from the sensor, and to communicate a signal based on the sensed data; and a receiver configured to receive the signal communicated from the processor and wherein the signal is used by the processor, in real time while the skier is wearing the ski boot and is skiing, to adjust the adjustable damper using mechanical servos or magnetic valves, to alter a return speed or a bias strength or resistance to movement of the adjustable damper to alter the forward flex and the rearward rebound movement of the ski boot.

2. The ski boot as claimed in claim 1, wherein, the cuff and the shell are coupled to one another to move about a first pivot axis, said first pivot axis configured to be located through an ankle joint of the foot of the skier when the foot of the skier is fitted to the ski boot, wherein the first pivot axis is configured so that the cuff and the shell rotate relative to each other about the first pivot axis via a first pivot bearing;

the cuff and the adjustable damper are coupled to one another via a second pivot bearing to permit rotation about a second pivot axis; and the adjustable damper and the shell are coupled to one another via a third pivot bearing to permit rotation about a third pivot axis.

3. The ski boot as claimed in claim 2, wherein, the forward flex causes rotation of the cuff forwards about the first pivot axis relative to the shell which, in turn causes a distance between the second pivot axis and the third pivot axis to reduce and hence cause a compression force on the adjustable damper; and the rearward rebound movement causes rotation of the cuff rearwards about the first pivot axis relative to the shell which, in turn causes the distance between the second pivot axis and the third pivot axis to increase and hence cause a tension force on the adjustable damper.

4. The ski boot as claimed in claim 2, wherein, the forward flex causes rotation of the cuff forwards about the first pivot axis relative to the shell which, in turn causes a distance between the second pivot axis and the third pivot axis to increase and hence cause a tension force on the adjustable damper; and the rearward rebound movement causes rotation of the cuff rearwards about the first pivot axis relative to the shell which, in turn causes the distance between the second pivot axis and the third pivot axis to decrease and hence cause a compression force on the adjustable damper.

5. The ski boot as claimed in claim 1, wherein the sensed data is measured by sensing one or more of: a speed of motion and an acceleration forward and aft of the cuff relative to the shell.

6. The ski boot as claimed in claim 1, wherein the adjustable damper controls the forward flex and the rearward rebound movement by controlling characteristics selected from one or more of: an extent of the forward flex and the rearward rebound movement; a speed of the forward flex and the rearward rebound movement; an acceleration of the forward flex and the rearward rebound movement.

7. The ski boot as claimed in claim 1, wherein adjustment of the adjustable damper is completed using: mechanical servos or magnetic valves.

8. The ski boot as claimed in claim 1, wherein the adjustable damper is configured to be adjusted automatically.

9. The ski boot as claimed in claim 1, wherein the rotational sensor is located on the cuff.

10. The ski boot as claimed in claim 1, wherein the rotational sensor is part of the cuff.

11. The ski boot as claimed in claim 1, wherein a compression force and a rebound speed of the adjustable damper does not change if a neutral forward lean angle of the ski boot is increased or decreased.

12. A method of adjusting characteristics of ski boot dampening comprising:

providing a ski boot configured to control and adjust a forward flex and a rearward rebound movement of the ski boot while the ski boot is in-use, the ski boot comprising a shell configured to receive and retain a foot of a skier;

a cuff configured to secure to a lower leg of the skier;

an adjustable damper coupled to the shell and the cuff, wherein the adjustable damper is configured to control and adjust the forward flex and the rearward rebound movement of the ski boot;

a sensor configured to measure sensed data about the forward flex and the rearward rebound movement of the ski boot about at least one pivot axis, wherein the sensor is a rotational sensor located on or about the at least one pivot axis and wherein the sensed data is measured by sensing a range of motion (ROM) of the cuff relative to the shell;

a processor configured to receive the sensed data and analyze the sensed data while the ski boot is in use, and to communicate a signal based on the sensed data; and, a receiver that configured to receive the signal communicated from the processor; and wherein the processor uses the signal, in real time, while the skier wearing the ski boot is skiing, to adjust the adjustable damper using mechanical servos or magnetic valves, to alter a return speed or a bias strength or resistance to movement of the adjustable damper to alter the forward flex and the rearward rebound movement of the ski boot.

13. The method as claimed in claim 12, wherein the processor assimilates other ski data relating to the skier in addition to the sensed data, and wherein the other ski data is linked to the sensed data received from the ski boot, the other ski data selected from:

number of days skied per year, number of ski runs per day, difficulty of ski runs, locations skied by resort, town and country;

speed and position of the skier;

an initial set-up for a location/ski session derived from: personal historical data, location weather, location ski conditions, crowd-sourced information such as other people's inputs/outputs in similar location/conditions.

14. The method as claimed in claim 12, wherein the sensed data is used to build a profile of an individual skier.

15. The method as claimed in claim 12, wherein the sensed data is used by a ski retailer to match ski equipment to individual users based on historical in-use data.

16. The method as claimed in claim 12, wherein the sensed data identifies when an individual has endured extreme range of motion movement, speeds and or forces which are precursors to serious accidents and injuries.

17. The method as claimed in claim 12, wherein the sensed data is used by a skier to change a characteristic of the adjustable damper as a skier gains or loses strength or, alternatively, improves or loses their technique.

18. The method as claimed in claim 12, wherein the sensed data identifies and then notifies a skier, via said processor:

that the skier is becoming fatigued, wherein fatigue of the skier is measured based on one or more of a number of runs, forces that are being generated, a number of days skied consecutively, historical data of said skier, and noted changes in forces generated during a day's skiing;

to set up the ski boot different from a second ski boot;

of an optimum compression force and rebound speed for identified snow conditions;

of optimum compression forces and rebound speeds for different ski turn radius.

* * * * *